US011668466B2

(12) United States Patent
Chon et al.

(10) Patent No.: US 11,668,466 B2
(45) Date of Patent: Jun. 6, 2023

(54) COMBUSTOR NOZZLE ASSEMBLY AND GAS TURBINE COMBUSTOR INCLUDING SAME

(71) Applicant: DOOSAN ENERBILITY CO., LTD, Changwon (KR)

(72) Inventors: Mu Hwan Chon, Changwon (KR); Young Jun Shin, Seongnam (KR)

(73) Assignee: DOOSAN ENERBILITY CO., LTD, Changwon (KR)

( * ) Notice: Subject to any disclaimer, the term of this patent is extended or adjusted under 35 U.S.C. 154(b) by 0 days.

(21) Appl. No.: 17/359,574

(22) Filed: Jun. 27, 2021

(65) Prior Publication Data

US 2022/0018542 A1 Jan. 20, 2022

(30) Foreign Application Priority Data

Jul. 17, 2020 (KR) ..... 10-2020-0088931

(51) Int. Cl.
*F23R 3/34* (2006.01)
*F23R 3/14* (2006.01)
*F23R 3/28* (2006.01)

(52) U.S. Cl.
CPC ..... *F23R 3/343* (2013.01); *F23R 3/14* (2013.01); *F23R 3/286* (2013.01); *F23R 3/28* (2013.01)

(58) Field of Classification Search
CPC .. F23R 3/286; F23R 3/343; F23R 3/14; F23R 3/28
See application file for complete search history.

(56) References Cited

U.S. PATENT DOCUMENTS 3,917,173 A * 11/1975 Singh ..... F23D 11/107 239/404
5,165,241 A 11/1992 Joshi
5,351,477 A * 10/1994 Joshi ..... F23D 17/002 60/737
5,613,363 A * 3/1997 Joshi ..... F23R 3/286 60/737
5,675,971 A * 10/1997 Angel ..... F23R 3/286 60/737
5,778,676 A * 7/1998 Joshi ..... F23D 17/002 60/737
6,438,961 B2 8/2002 Tuthill
9,939,157 B2 * 4/2018 Patel ..... F23R 3/343
2005/0039456 A1 * 2/2005 Hayashi ..... F23R 3/32 60/737

(Continued)

FOREIGN PATENT DOCUMENTS

KR 1020200038698 A 6/2020
KR 102343002 B1 * 12/2021

OTHER PUBLICATIONS

KR OA dated Jul. 23, 2021.

*Primary Examiner* — William H Rodriguez
(74) *Attorney, Agent, or Firm* — Harvest IP Law LLP

(57) ABSTRACT

A combustor nozzle assembly and a gas turbine combustor including the same are provided. The combustor nozzle assembly includes a central nozzle tube, an inner nozzle tube surrounding the central nozzle tube in a spaced-apart state, an outer nozzle tube surrounding the inner nozzle tube in a spaced-apart state, a pilot fuel injector provided between the central nozzle tube and the inner nozzle tube, and a main fuel injector provided between the inner nozzle tube and the outer nozzle tube.

19 Claims, 11 Drawing Sheets

(56) References Cited

U.S. PATENT DOCUMENTS

| | | | | |
|---|---|---|---|---|
| 2005/0268618 | A1* | 12/2005 | Johnson | F23R 3/286 60/737 |
| 2006/0168966 | A1* | 8/2006 | Stuttaford | F23R 3/343 60/39.094 |
| 2007/0137207 | A1* | 6/2007 | Mancini | F23R 3/286 60/737 |
| 2007/0271927 | A1* | 11/2007 | Myers | F23R 3/346 60/776 |
| 2008/0173019 | A1* | 7/2008 | Kobayashi | F23R 3/286 60/740 |
| 2008/0236165 | A1* | 10/2008 | Baudoin | F23R 3/343 60/746 |
| 2016/0061452 | A1* | 3/2016 | Walker | F23R 3/286 60/737 |
| 2016/0363319 | A1* | 12/2016 | Monahan | F23D 14/64 |
| 2017/0002743 | A1* | 1/2017 | Jorgensen | F02C 7/222 |
| 2017/0122211 | A1* | 5/2017 | Zhang | F02C 7/222 |
| 2019/0346142 | A1* | 11/2019 | Cires | F23R 3/343 |
| 2020/0355371 | A1* | 11/2020 | Lind | F23R 3/34 |
| 2022/0003167 | A1* | 1/2022 | Shershnyov | F23R 3/16 |

* cited by examiner

COMBUSTOR NOZZLE ASSEMBLY AND GAS TURBINE COMBUSTOR INCLUDING SAME

CROSS REFERENCE TO RELATED APPLICATION

This application claims priority to Korean Patent Application No. 10-2020-0088931, filed on Jul. 17, 2020, the disclosure of which is incorporated herein by reference in its entirety.

BACKGROUND

1. Field

Apparatuses and methods consistent with exemplary embodiments relate to a combustor nozzle assembly and a gas turbine combustor including the same and, more particularly, to a combustor nozzle assembly in which a coaxial two-stage stratified combustion is possible and fuel is supplied through an annular ring, thereby obtaining excellent fuel-air mixing characteristics and improved flame stability and a gas turbine combustor including the same.

2. Description of the Related Art

A gas turbine is a combustion engine that converts thermal energy into mechanical energy by mixing compressed air compressed by a compressor at high pressure with fuel, combusting the air-fuel mixture to produce a high-temperature and high-pressure combustion gas, and injecting the combustion gas to a turbine section to rotate the turbine section. Because these gas turbines do not have reciprocating mechanism such as piston which is usually provided in 4-stroke engine, so that there is no mutual friction part such as piston-cylinder, the gas turbines have advantages that consumption of lubricating oil is extremely small, an amplitude feature which is characteristic of reciprocating machine is greatly reduced, and the gas turbines are able to operate at high speed.

A gas turbine includes a compressor that compresses air, a combustor that mixes the compressed air supplied from the compressor with fuel and combusts the compressed air-fuel mixture to produce combustion gas, and a turbine that generates power by rotating turbine blades using high-temperature and high-pressure combustion gas injected from the combustor.

The combustor may mix fuel with compressed air supplied from the compressor, combust the mixture to generate high-temperature and high-pressure combustion gas having high energy, and increase through an isostatic heating process the temperature of the combustion gas to a heat resistant limit temperature at which the turbine metal can withstand. Here, the combustor serves as an element that allows high-temperature and high-pressure air from the compressor to react with fuel to obtain high energy, which is transferred to the turbine to drive the turbine.

Referring to FIG. 1, a flow of combustion air is supplied along a space between a sleeve 1 and a combustor liner 2 while cooling the combustor and is turned into the combustor liner 2 through a nozzle 3 from which fuel is supplied, so that the fuel and air are ignited within the combustor liner 2.

In the combustor, it is necessary to control the temperature of a reaction zone of the combustor to a low level so that air pollutants emitted through combustion, e.g., nitrogen oxides (NOx), are generated below a reference value. To this end, fuel and air may be premixed into a lean mixture in the nozzle 3 before being combusted and then supplied to the reaction zone of the combustor.

At this time, the fuel-air mixture flowing from the premixing zone of the combustor to the reaction zone of the combustor needs to be very uniform to achieve the desired emission standard. This is because if there are portions in which fuel-rich mixture having significantly more fuel than average exists, combustion products in the portions can reach higher-than-average temperatures to form thermal nitrogen oxides (NOx). Conversely, if there are portions in which fuel-poor mixture having significantly poor fuel than average exists, quenching may occur in the portions because hydrocarbons and/or carbon monoxide cannot be oxidized to an equilibrium level, which may not satisfy the emission standards for unburned hydrocarbons (UHC) and/or carbon monoxide (CO). Therefore, it is necessary to create a sufficiently uniform fuel-air mixture distribution to satisfy the desired emission standards.

In addition, to accomplish the desired emission performance, the fuel-air mixture concentration needs to be reduced to a level close to the lean combustion limit for substantially complete combustion of hydrocarbon fuel, resulting in reducing flame propagation rates and emissions. Accordingly, the lean-premix combustor tends to have a more unstable combustion rate than a general diffusion-flame combustor, and a high level of combustion-driven dynamic pressure fluctuation occurs. Because such dynamic pressure fluctuations can lead to negative consequences such as combustor damage, it is important to control the combustion dynamics to an acceptable low level.

To this end, in a related art, there is provided a Swozzle-type burner having a cylindrical central body extending below a center line thereof. An end part of the central body provides a bluff body to form a strong recirculation area in which the flame is fixed, thereby having excellent flame stability. However, there is a problem in that this Swozzle-type burner does not achieve uniform mixing of fuel and air.

In addition, in a related art, there is provided a dual annular counter rotating swirler (DACRS) type air-fuel mixer. The DACRS type air-fuel mixer has excellent fuel-air mixing characteristics due to high fluid shear and turbulence. However, such a swirler does not generate a strong recirculation flow at a central line thereof, and a flow pattern in a combustion chamber is greatly changed due to a sudden change in a turning angle occurring in a boundary layer, resulting in lower flame stability. Accordingly, it is often necessary to additionally inject non-premixed fuel to stabilize the combustion flame, so there is a problem in that the emission of nitrogen oxides (NOx) is increased by the non-premixed fuel.

SUMMARY

Aspects of one or more exemplary embodiments provide a combustor nozzle in which the coaxial two-stage stratified combustion is possible and fuel is supplied through an annular ring, thereby improving flame stability while having excellent fuel-air mixing characteristics, and a gas turbine combustor including the combustor nozzle assembly.

Additional aspects will be set forth in part in the description which follows and, in part, will become apparent from the description, or may be learned by practice of the exemplary embodiments.

According to an aspect of an exemplary embodiment, there is provided a combustor nozzle assembly including: a central nozzle tube; an inner nozzle tube surrounding the central nozzle tube in a spaced-apart state; an outer nozzle tube surrounding the inner nozzle tube in a spaced-apart state; a pilot fuel injector provided between the central nozzle tube and the inner nozzle tube; and a main fuel injector provided between the inner nozzle tube and the outer nozzle tube.

A pilot flow path may be formed between the central nozzle tube and the inner nozzle tube, and a main flow path may be formed between the inner nozzle tube and the outer nozzle tube, wherein fuel-air concentration in the pilot flow path and fuel-air concentration in the main flow path are adjusted to be equal to or different from each other according to an operation purpose.

A fuel concentration in the pilot flow path may be adjusted to be higher or lower than a fuel concentration in the main flow path according to the operation purpose.

The pilot fuel injector may include: a pilot annular ring disposed between the central nozzle tube and the inner nozzle tube; and a plurality of pilot struts extending radially from the central nozzle tube toward the pilot annular ring.

The plurality of pilot struts may be arranged at regular intervals along a circumferential direction of the central nozzle tube.

The pilot annular ring may include a plurality of first fuel injection holes along a circumferential direction thereof.

The plurality of first fuel injection holes may be formed in each of radially inner and outer surfaces of the annular pilot ring.

A second fuel injection hole may be formed in each of the plurality of pilot struts.

Each of the plurality of pilot struts may be provided with a plurality of second fuel injection holes on side surfaces facing each other in a circumferential direction of the pilot strut.

Each of the plurality of pilot struts may include: a first pilot strut part extending from the central nozzle tube to the pilot annular ring; and a second pilot strut part extending radially from the pilot annular ring toward the inner nozzle tube.

The main fuel injector may include: at least one main annular ring disposed between the inner nozzle tube and the outer nozzle tube; and a plurality of main struts extending radially from the inner nozzle tube toward the main annular ring.

The plurality of main struts may be arranged at regular intervals along a circumferential direction of the inner nozzle tube.

The main annular ring may include a plurality of third fuel injection holes along a circumferential direction thereof.

The plurality of third fuel injection holes may be formed in each of radially inner and outer surfaces of the main annular ring.

A fourth fuel injection hole may be formed in each of the plurality of main struts.

Each of the plurality of main struts may be provided with a plurality of fourth fuel injection holes on side surfaces facing each other in a circumferential direction of the main strut.

Each of the plurality of main struts may include: a first main strut part extending from the inner nozzle tube to the main annular ring; and a second main strut part extending radially from the main annular ring toward the outer nozzle tube.

The combustor nozzle assembly may further include a main swirler provided on a downstream side of the main fuel injector in an airflow direction to generate a swirling flow, wherein the central nozzle tube, the inner nozzle tube, the pilot fuel injector, and the main fuel injector are inserted in an assembled state into the outer nozzle tube to which the main swirler is attached.

The pilot annular ring may have a rear side corrugated in a radial direction thereof.

According to an aspect of another exemplary embodiment, there is provided a gas turbine combustor including: a liner configured to define a combustion chamber; a flow sleeve configured to surround the liner to form an annular flow space therebetween; an end plate coupled to a front side of the flow sleeve; and a nozzle assembly supported by the end plate and coupled to a front side of the liner, wherein the nozzle assembly may include: a central nozzle tube; an inner nozzle tube surrounding the central nozzle tube in a spaced-apart state; an outer nozzle tube surrounding the inner nozzle tube in a spaced-apart state; a pilot fuel injector provided between the central nozzle tube and the inner nozzle tube; and a main fuel injector provided between the inner nozzle tube and the outer nozzle tube.

According to one or more exemplary embodiments, the fuel-air mixing can be improved as fuel is injected into each of two flow paths separated in the coaxial triple tube by the pilot annular ring and the main annular ring, thereby ultimately minimizing generation of nitrogen oxides (NOx) in the gas turbine combustor.

In addition, as the two-stage stratified combustion in which the combustion conditions of the pilot and the main states are different is possible, flame stability can be improved and the combustion fluctuation can be suppressed, thereby obtaining stable combustion.

Further, as the fuel injection hole is additionally provided in the outer nozzle tube to inject fuel therethrough, the fuel-air mixing can be improved even in the vicinity of the outer nozzle tube in which the distance between adjacent struts is relatively far.

BRIEF DESCRIPTION OF THE DRAWINGS

The above and other aspects will be more clearly understood from the following description of the exemplary embodiments with reference to the accompanying drawings, in which.

DETAILED DESCRIPTION

Figure 1:
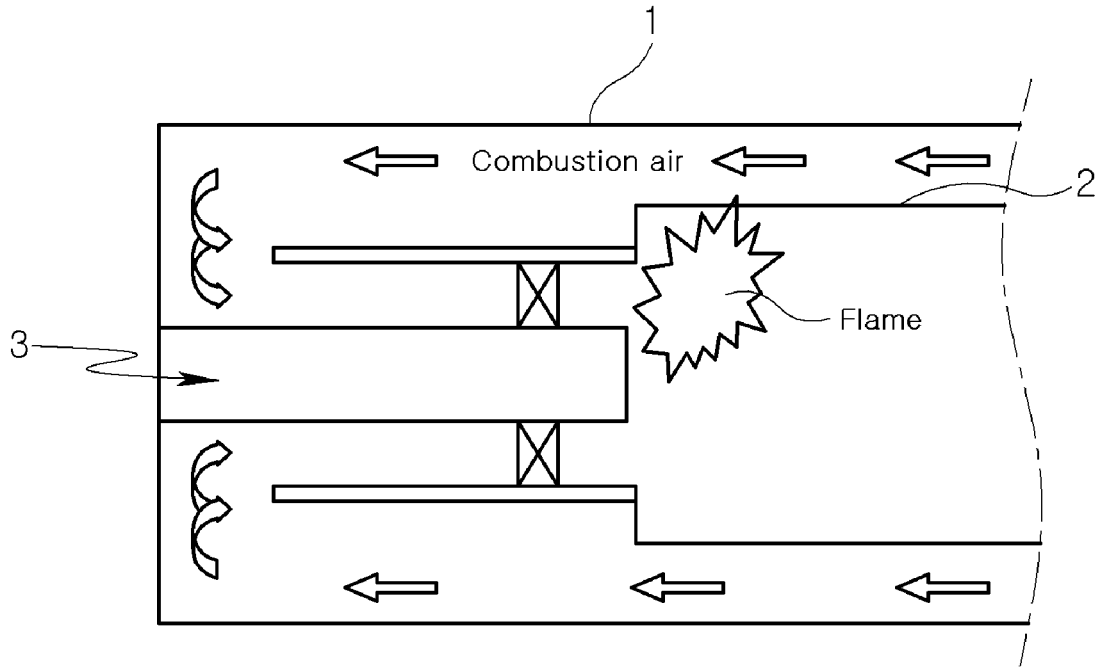
FIG. 1 is a schematic cross-sectional view illustrating a related art gas turbine combustor.

Various modifications and various embodiments will be described with reference to the accompanying drawings.

However, it should be noted that the various embodiments are not for limiting the scope of the disclosure to the specific embodiment, but they should be interpreted to include all modifications, equivalents, or substitutions of the embodiments included within the spirit and scope disclosed herein.

Terms used herein are used to merely describe specific embodiments, and are not intended to limit the scope of the disclosure. As used herein, an element expressed as a singular form includes a plurality of elements, unless the context clearly indicates otherwise. Further, it will be understood that the term "comprising" or "including" specifies the presence of stated features, numbers, steps, operations, elements, parts, or combinations thereof, but does not preclude the presence or addition of one or more other features, numbers, steps, operations, elements, parts, or combinations thereof.

For clear illustration, components that are irrelevant to the description are omitted, and like reference numerals refer to like components throughout the specification. In certain embodiments, a detailed description of known functions and configurations that may obscure the gist of the present disclosure will be omitted. For the same reason, some of the elements in the drawings are exaggerated, omitted, or schematically illustrated.

Figure 2:
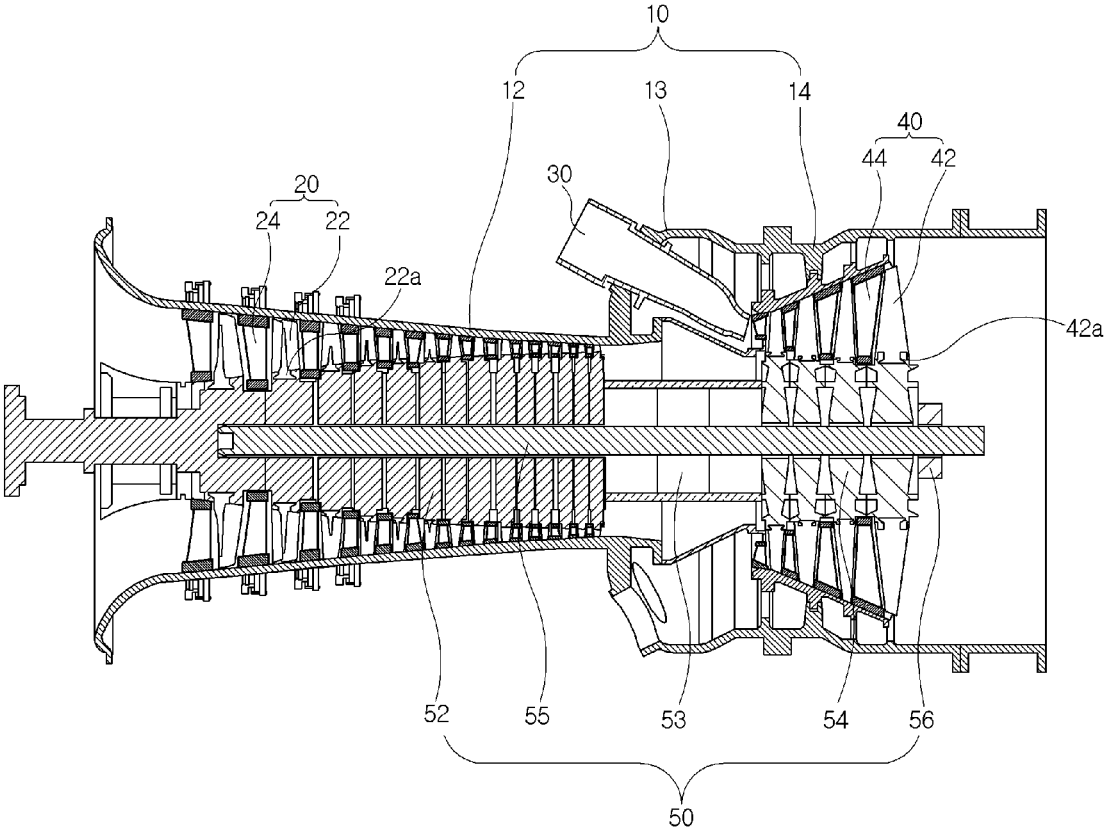
FIG. 2 is a cross-sectional view illustrating a gas turbine according to an exemplary embodiment.
Figure 3:
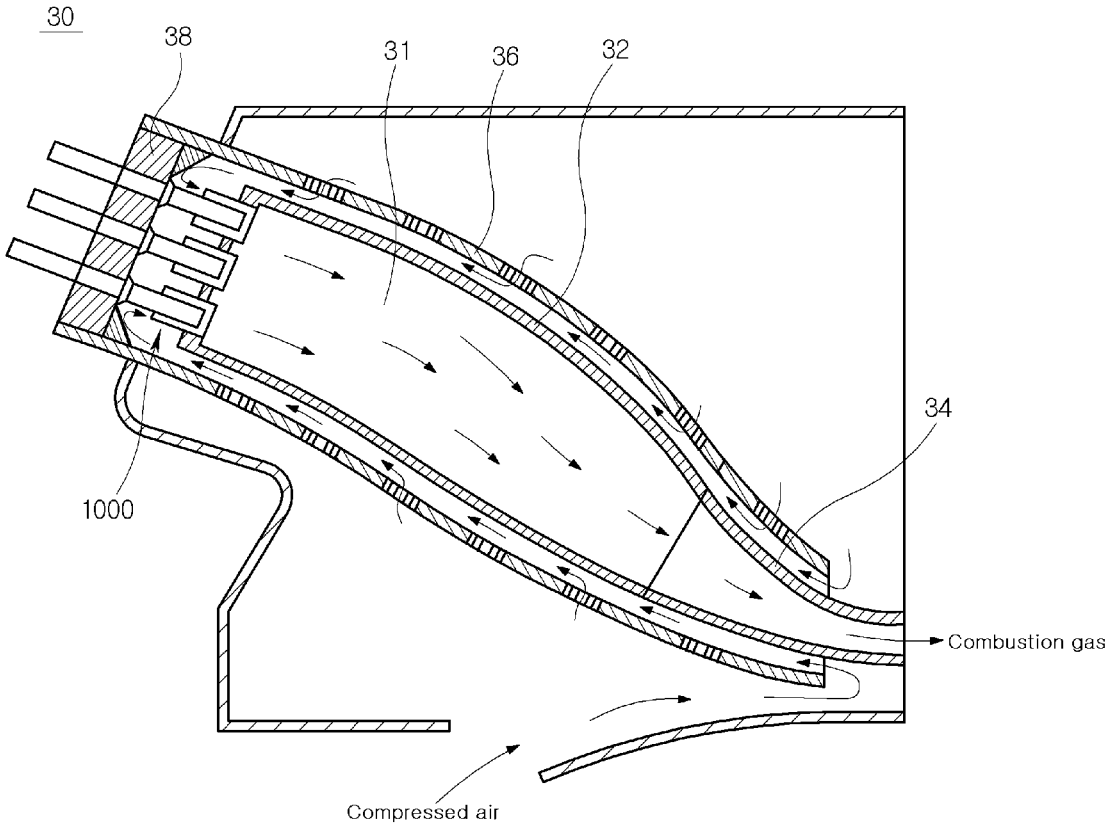
FIG. 3 is an enlarged cross-sectional view illustrating a combustor in the gas turbine of FIG. 2.

Hereinafter, a configuration of a gas turbine according to an exemplary embodiment will be described with reference to the accompanying drawings. FIG. 2 is a cross-sectional view illustrating a gas turbine according to an exemplary embodiment, and FIG. 3 is an enlarged cross-sectional view illustrating a combustor in the gas turbine of FIG. 2.

Referring to FIG. 2, the gas turbine includes a casing 10, a compressor 20 that sucks and compresses air at a high pressure, a combustor 30 that mixes the compressed air compressed by the compressor 20 with fuel to combust an air-fuel mixture, and a turbine 40 that obtains a rotational force by the combustion gas transmitted from the combustor 30 to generate electric power.

The casing 10 includes a compressor casing 12 in which the compressor 20 is accommodated, a combustor casing 13 in which the combustor 30 is accommodated, and a turbine casing 14 in which the turbine 40 is accommodated. Here, the compressor casing 12, the combustor casing 13, and the turbine casing 14 may be sequentially arranged from an upstream side to a downstream side in a direction of fluid flow.

A rotor 50 is rotatably provided inside the casing 10, and a generator (not shown) is interlocked with the rotor 50 for power generation, and a diffuser may be provided on the downstream side of the casing 10 to discharge the combustion gas passing through the turbine 40.

The rotor 50 may include a compressor rotor disk 52 accommodated in the compressor casing 12, a turbine rotor disk 54 accommodated in the turbine casing 14, a torque tube 53 accommodated in the combustor casing 13 to connect the compressor rotor disk 52 and the turbine rotor disk 54, and a tie rod 55 and a fastening nut 56 coupling the compressor rotor disk 52, the torque tube 53 and the turbine rotor disk 54.

The compressor rotor disk 52 may include a plurality of compressor rotor disks arranged along an axial direction of the rotor 50. That is, the compressor rotor disks 52 may be arranged in multiple stages. Each of the compressor rotor disks 52 may have a substantially disk shape and include a compressor blade slot formed in an outer periphery thereof such that a compressor blade 22 may be fitted into the compressor blade slot.

The turbine rotor disk 54 has a structure similar to the compressor rotor disk 52. That is, the turbine rotor disk 54 may include a plurality of turbine rotor disks arranged along an axial direction of the rotor 50. That is, the turbine rotor disks 54 may be arranged in multiple stages. Each of the turbine rotor disks 54 may have a substantially disk shape and include a turbine blade slot formed in an outer periphery thereof such that a turbine blade 42 may be fitted into the turbine blade slot.

The torque tube 53 is a torque transmission member for transmitting the rotational force of the turbine rotor disk 54 to the compressor rotor disk 52. One end of the torque tube 53 may be coupled to a most downstream side compressor rotor disk of the compressor rotor disks 52 in a flow direction of air, and the other end of the torque tube 53 may be coupled to a most upstream side turbine rotor disk of the turbine rotor disks 54 in a flow direction of combustion gas. Here, the torque tube 53 may include a protrusion formed at each of one end and the other end thereof, each of the compressor rotor disk 52 and the turbine rotor disk 54 may include a groove engaged with the protrusion to prevent relative rotation of the torque tube 53 with respect to the compressor rotor disk 52 and the turbine rotor disk 54. Further, the torque tube 53 may have a hollow cylindrical shape so that the air supplied from the compressor 20 may flow through the torque tube 53 to the turbine 40.

The tie rod 55 may pass through the plurality of compressor rotor disks 52, the torque tube 53 and the plurality of turbine rotor disks 54. One end of the tie rod 55 may be fastened to a most upstream side compressor rotor disk of the compressor rotor disks 52 in the flow direction of air, and the other end of the tie rod 55 may protrude in a direction opposite to the compressor 20 with respect to a most downstream side turbine rotor disk of the turbine rotor disks 54 in the flow direction of the combustion gas, so as to be fastened to the fastening nut 56.

Here, the fastening nut 56 tightens the most downstream side turbine rotor disk 54 toward the compressor 20 to reduce the distance between the most upstream side compressor rotor disk 52 and the most downstream side turbine rotor disk 54, thereby compressing the compressor rotor disks 52, the torque tube 53, and the turbine rotor disks 54 in the axial direction of the rotor 50. Accordingly, axial movement and relative rotation of the plurality of compressor rotor disks 52, the torque tube 620, and the plurality of turbine rotor disks 54 can be prevented.

It is understood that the type of the tie rod 55 may not be limited to the example illustrated in FIG. 2, and may be changed or vary according to one or more other exemplary embodiments. For example, there are three types of tie rods: a single-type in which a single tie rod extends through the center of the compressor rotor disks; a multi-type in which multiple tie rods are arranged in a circumferential direction; and a complex type in which the single-type and the multi-type are combined.

The compressor 20 may include a compressor blade 22 rotated along with the rotor 50 and a compressor vane 24 mounted on the compressor casing 12 to align an air flow flowing into the compressor blade 22.

The compressor blade 22 may include a plurality of compressor blades arranged in multiple stages along the axial direction of the rotor 50, and the plurality of compressor blades 22 may be arranged radially along the rotation direction of the rotor 50 for each stage. Each of the compressor blades 22 may include a root portion 22*a* that is fitted into the compressor blade slot of the compressor rotor disk 52. The root portion 22*a* may have a fir-tree shape to prevent the compressor blade 22 from being detached from the compressor blade slot in the radial direction of the rotor 50. In this case, the compressor blade slot may also have a fir-tree shape corresponding to the shape of the root portion 22*a* of the compressor blade 22.

Although the root portion 22*a* of the compressor blade 22 and the compressor blade slot are illustrated as having a fir-tree shape in FIG. 2, it is not limited thereto. For example, they may have a dovetail shape. Alternatively, the compressor blade 22 may be coupled to the compressor rotor disk 52 by using other types of coupling members such as keys or bolts.

For example, the compressor rotor disk 52 and the compressor blade 22 may be coupled in a tangential type or an axial type. Here, the compressor rotor disk 52 and the compressor blade 22 are formed to be coupled in the axial type so that the root portion 22*a* of the compressor blade 22 is fitted into the compressor blade slot along the axial direction of the rotor 50. Accordingly, the compressor blade slot may include a plurality of compressor blade slots arranged radially along the circumferential direction of the compressor rotor disk 52.

The compressor vane 24 may include a plurality of compressor vanes arranged in multiple stages along the axial direction of the rotor 50. Here, the compressor vanes 24 and the compressor blades 22 may be alternately arranged along a flow direction of air. Further, the plurality of compressor vanes 24 may be radially formed for each stage along the rotational direction of the rotor 50.

The combustor 30 mixes the air introduced from the compressor 20 with fuel and combusts a fuel-air mixture to produce a high-temperature and high-pressure combustion gas. A plurality of combustors constituting the combustor 30 are arranged along the rotational direction of the rotor 50 in the combustor casing.

Referring to FIG. 3, each of the combustors 30 includes a liner 32 into which air compressed in the compressor 20 flows, and a transition piece 34 disposed behind the liner 32 to guide the combustion gas to the turbine 40. The liner 32 has a combustion chamber 31 therein, and a flow sleeve 36 is disposed to annularly surround the liner 32 and the transition piece 34.

In addition, the combustor 30 includes a plurality of combustor nozzle assemblies 1000 for mixing air supplied from the compressor 20 with fuel, and each of the combustor nozzle assemblies 1000 is coupled to a front side of the liner 32. An end plate 38 is coupled to the front side of the combustor casing 13 or the flow sleeve 36 so that the combustor nozzle assembly 1000 may be supported and the combustor 30 may be sealed by the end plate 38.

It is important to cool the liner 32 and the transition piece 34 that are exposed to high-temperature and high-pressure combustion gas in order to increase durability of the combustor 30. To this end, compressed air (i.e., combustion air) may be introduced into an annular flow path between the liner 32, the transition piece 34, and the flow sleeve 36 through a plurality of collision holes formed in the flow sleeve 36 from an accommodation space defined by the combustor casing 13 to accommodate the compressed air discharged from the compressor 20.

The compressed air introduced into the annular flow path between the liner 32, the transition piece 34, and the flow sleeve 36 flows toward the front side of the combustor 30 while cooling the outer wall portions of the liner 32 and the transition piece 34. After reaching the end plate 38, the compressed air turns to an opposite side and is supplied to the nozzle assembly 1000. That is, the compressed air introduced from the compressor 20 is injected into the combustion chamber 31 while mixing with fuel through the nozzle assembly 1000, and is ignited and combusted by a spark plug (not shown) in the combustion chamber 31. Thereafter, the combusted gas is discharged to the turbine 40 through the transition piece 34 to generate a rotational force.

The turbine 40 has a structure similar to the compressor 20. The turbine 40 may include a turbine blade 42 rotated together with a rotor 50, and a turbine vane 44 fixed to the turbine casing 14 to align a flow of air flowing into the turbine blade 42.

The turbine blade 42 may include a plurality of turbine blades arranged in multiple stages along the axial direction of the rotor 50, and the plurality of turbine blades may be radially formed for each stage along the rotation direction of the rotor 50.

Each of the turbine blades 42 may have a root portion 42*a* that is fitted into the turbine blade slot of the turbine rotor disk 54 The root portion 42*a* may have a fir-tree shape to prevent the turbine blade 42 from being detached from the turbine blade slot in the radial direction of the rotor 50. In this case, the turbine blade slot may also have a fir-tree shape corresponding to the shape of the root portion 42*a* of the turbine blade.

The turbine vane 44 may include a plurality of turbine vanes arranged in multiple stages along the axial direction of the rotor 50. Here, the turbine vanes 44 and the turbine blades 42 may be alternately arranged along a flow direction of air. Further, the plurality of turbine vanes 44 may be radially formed for each stage along the rotational direction of the rotor 50.

Because the turbine 40 is in direct contact with a high-temperature and high-pressure combustion gas unlike the compressor 20, the turbine 40 requires a cooling means to prevent damage such as deterioration. To this end, the gas turbine according to the exemplary embodiment may include a cooling path through which some of the compressed air is additionally supplied from a portion of the compressor 20 to the turbine 40.

The cooling path may have an external path (which extends outside the casing 10), an internal path (which extends through the interior of the rotor 50), or both of the external path and the internal path.

The cooling path may employ an outer path externally extends around the casing 10, an inner path internally extends through the rotor 50, or a combination thereof. In this case, the cooling path may communicate with a turbine blade cooling path formed in the turbine blade 42 to cool the turbine blade 42 by cooling air. In addition, the turbine blade cooling path may communicate with a turbine blade film cooling hole formed in a surface of the turbine blade 42 so that the cooling air is supplied to the surface of the turbine blade 42, thereby enabling the turbine blade 42 to be cooled by the cooling air in a film cooling manner. The turbine vane 44 may also be cooled by cooling air supplied from the cooling path.

It is understood that the gas turbine is given merely by way of an example, and the combustor of the exemplary embodiments can be widely applied to a jet engine in which air and fuel are combusted.

Hereinafter, a combustor nozzle assembly 1000 according to an embodiment will be described in detail with reference to FIGS. 4 to 6.

Figure 4:
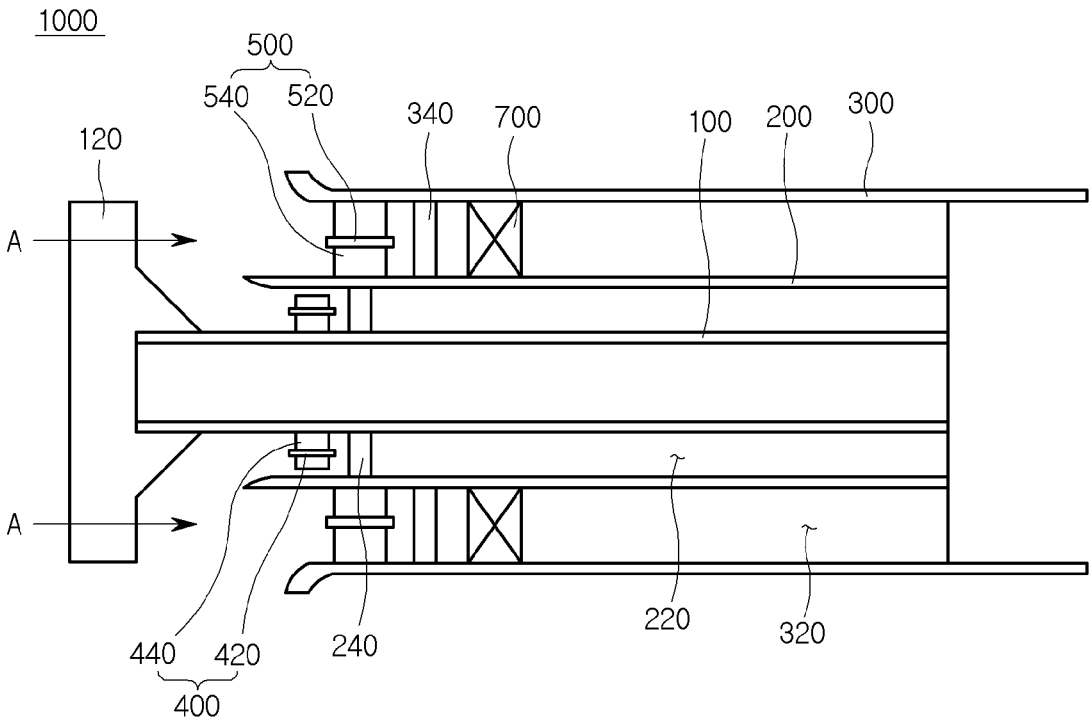
FIG. 4 is a cross-sectional view illustrating a combustor nozzle assembly according to an exemplary embodiment.
Figure 5:
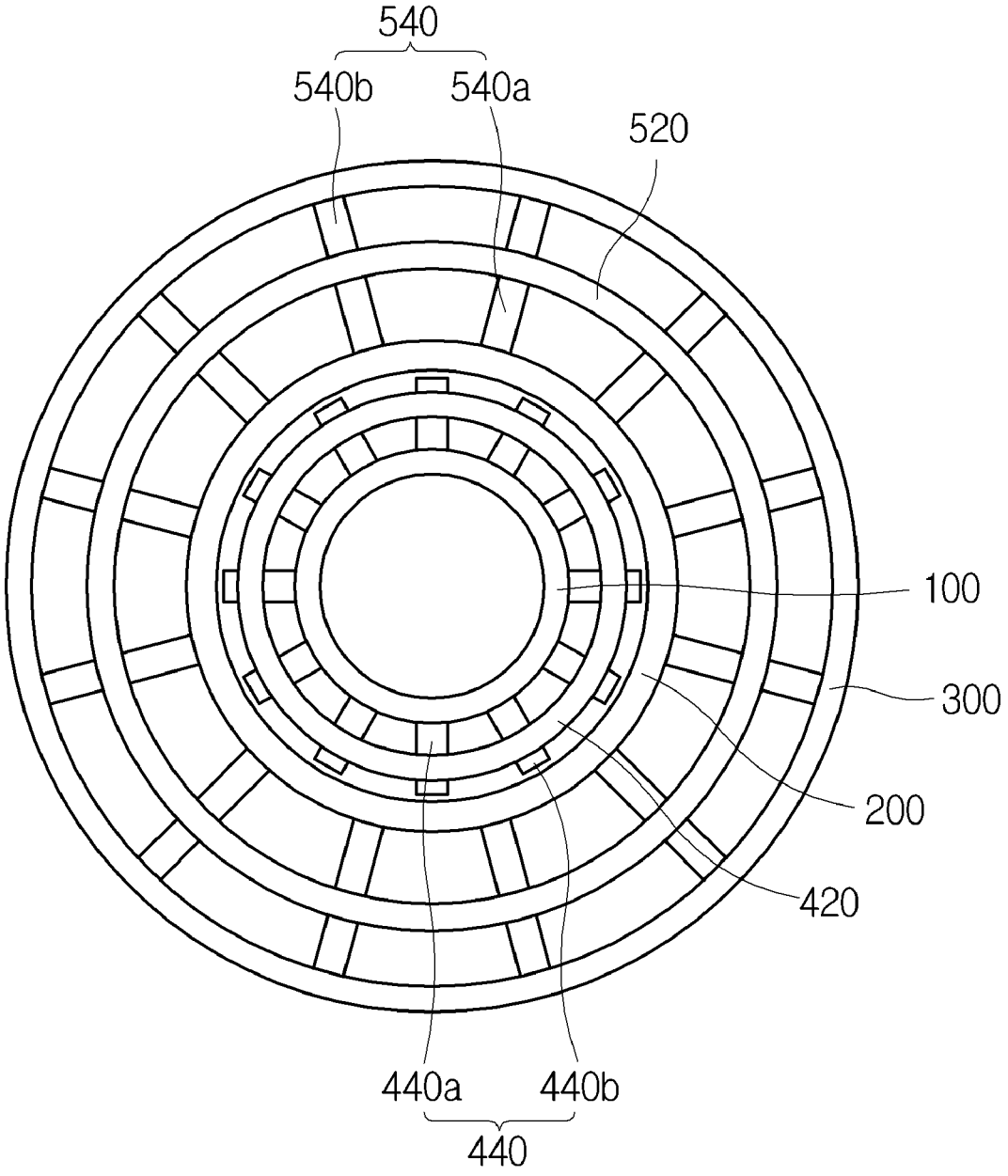
FIG. 5 is a side view taken along section A of FIG. 4.
Figure 6:
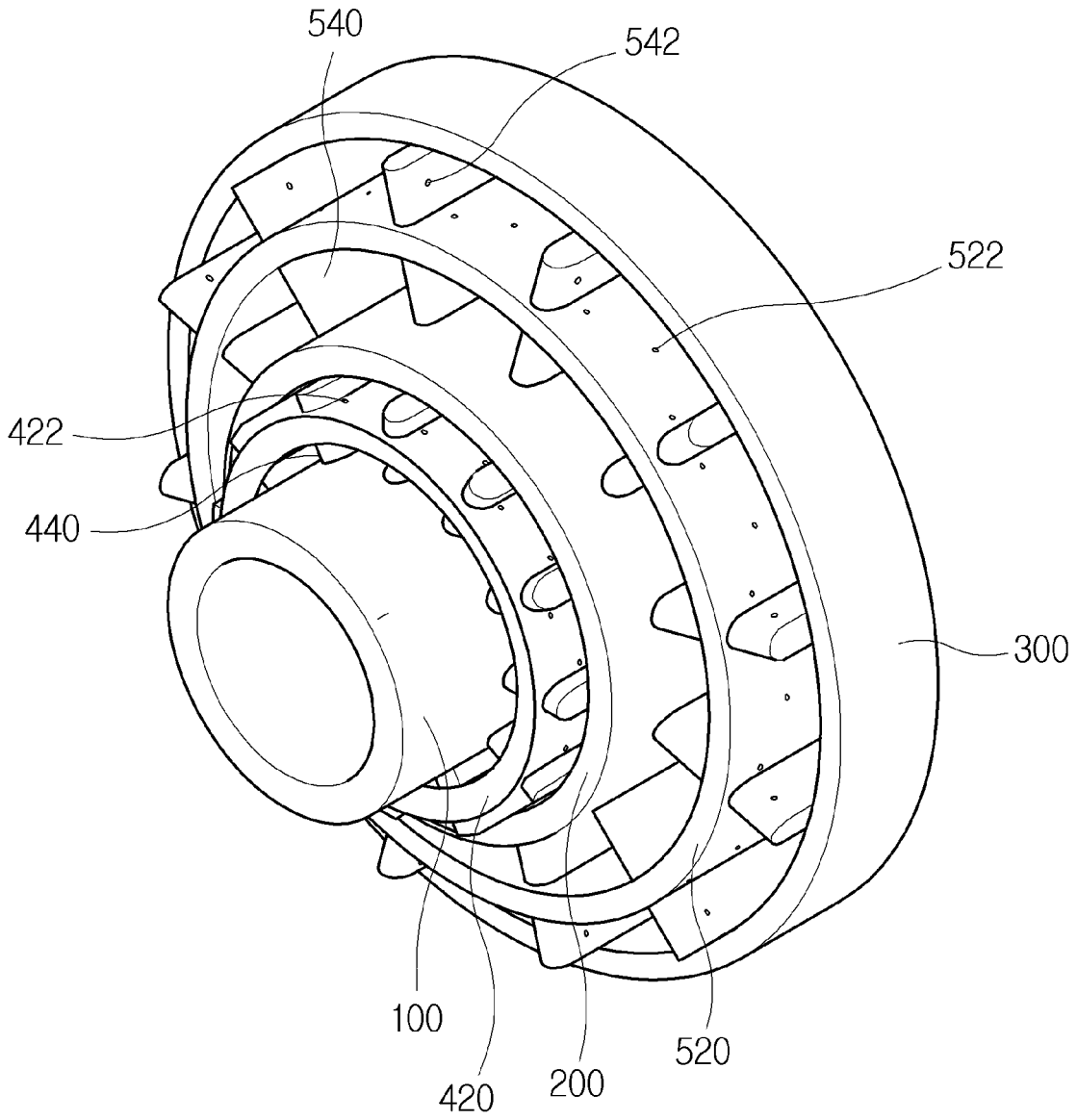
FIG. 6 is a perspective view illustrating a part of the configuration of FIG. 4.

Referring to FIGS. 4 to 6, the combustor nozzle assembly 1000 includes a central nozzle tube 100, an inner nozzle tube 200 surrounding the central nozzle tube 100 in a spaced-apart state, and an outer nozzle tube 300 surrounding the inner nozzle tube 200 in a spaced-apart state, and the central nozzle tube 100, the inner nozzle tube 200, and the outer nozzle tube 300 are arranged in a coaxial manner. Accordingly, a pilot flow path 220 is formed between the central nozzle tube 100 and the inner nozzle tube 200, and a main flow path 320 is formed between the inner nozzle tube 200 and the outer nozzle tube 300. That is, two separate flow paths are formed from the coaxial triple-tube structure of the nozzle assembly 1000.

A pilot fuel injector 400 for injecting fuel is provided between the central nozzle tube 100 and the inner nozzle tube 200, that is, in the pilot flow path 220. The pilot fuel injector 400 may include a pilot annular ring 420 and a plurality of pilot struts 440 extending radially from the central nozzle tube 100 toward the pilot annular ring 420. Although not limited thereto, it is preferable that the plurality of pilot struts 440 are provided at regular intervals along the circumferential direction.

The pilot struts 440 extend from the central nozzle tube 100 to the pilot annular ring 420, and may further extend radially from the pilot annular ring 420 toward the inner nozzle tube 200. As illustrated in FIG. 5, each of the pilot struts 440 includes a first pilot strut part 440*a* extending from the central nozzle tube 100 to the pilot annular ring 420 and a second pilot strut part 440*b* extending radially from the pilot annular ring 420 toward the inner nozzle tube 200. Here, although a radially outer end of the second pilot strut part 440*b* is spaced apart from the inner nozzle tube 200, it is not limited thereto, and the second pilot strut part 440*b* may extend to the inner nozzle tube 200.

As illustrated in FIG. 6, the pilot annular ring 420 is provided with a plurality of first fuel injection holes 422 along the circumferential direction. For example, the plurality of first fuel injection holes 422 are provided at regular intervals on both a radially inner surface and a radially outer surface of the pilot annular ring 420. Accordingly, fuel can be injected toward both radially inner and outer surfaces of the pilot annular ring 420, and thus a fuel-air mixing degree may be improved. Although not limited thereto, the plurality of first fuel injection holes 422 are preferably provided uniformly along the circumferential direction of the pilot annular ring 420. For example, two first fuel injection holes 422 may be disposed at regular intervals from each other between adjacent pilot struts 440. Accordingly, fuel and air are uniformly mixed along the circumferential direction of the pilot annular ring 420 to improve the degree of mixing.

In addition, a second fuel injection hole 442 may be provided in each of the pilot struts 440. It is preferable that a plurality of second fuel injection holes 442 are provided in each of the pilot struts 440 such that the second fuel injection holes 442 are formed in side surfaces of the pilot struts facing each other in the circumferential direction. Accordingly, fuel can be injected in the radial direction by the first fuel injection holes 422 of the pilot annular ring 420 and can also be injected in the circumferential direction by the second fuel injection holes 442 of the pilot strut 440. Therefore, it is possible to provide a uniform fuel-air mixture by improving the degree of fuel-air mixing. In this way, a desired equivalence ratio distribution may be obtained by adjusting the number and positions of the fuel injection holes.

Further, a main fuel injector 500 for injecting fuel is provided between the inner nozzle tube 200 and the outer nozzle tube 300, that is, in the main flow path 320. The main fuel injector 500 may include a main annular ring 520 and a plurality of main struts 540 extending radially from the inner nozzle tube 200 toward the main annular ring 520. Although not limited thereto, the main struts 540 are preferably provided at regular intervals along the circumferential direction.

The main struts 540 extend from the inner nozzle tube 200 to the main annular ring 520, and may further extend radially from the main annular ring 520 toward the outer nozzle tube 300. As illustrated in FIG. 5, each of the main struts 540 includes a first main strut part 540*a* extending from the inner nozzle tube 200 to the main annular ring 520 and a second main strut part 540*b* extending in the radial direction from the main annular ring 520 toward the outer nozzle tube 300. Here, although the second main strut part 540*b* extends to the outer nozzle tube 300, it is not limited thereto, and a radially outer end of the second main strut part 540*b* may be spaced apart from the outer nozzle tube 300. In addition, the first main strut part 540*a* and the second main strut part 540*b* may be alternately disposed in the circumferential direction of the main annular ring 520.

As illustrated in FIG. 6, the main annular ring 520 is provided with a plurality of third fuel injection holes 522 along the circumferential direction. The third fuel injection holes 522 are preferably provided on both the radially inner and outer surfaces of the main annular ring 520. Accordingly, fuel can be injected toward both the radially inner and outer surfaces of the main annular ring 520, so the degree of fuel-air mixing may be improved. In addition, although not limited thereto, the third fuel injection holes 522 are preferably provided uniformly along the circumferential direction of the main annular ring 520. For example, three third fuel injection holes 522 may be disposed at regular intervals from each other between adjacent main struts 540. Accordingly, the fuel-air mixing is uniformly performed along the circumferential direction of the main annular ring 520 to improve the degree of mixing.

In addition, a fourth fuel injection hole 542 may be provided in each of the pilot struts 540. It is preferable that a plurality of fourth fuel injection holes 542 are provided in each of the pilot struts 540 such that the fourth fuel injection holes 542 are formed in side surfaces of the main struts 540 facing each other in the circumferential direction. Accordingly, fuel can be injected in the radial direction by the third fuel injection holes 522 of the main annular ring 520 and can also be injected in the circumferential direction by the fourth fuel injection holes 542 of the main strut 540. Thus, it is possible to provide a uniform fuel-air mixture by improving the degree of fuel-air mixing. In this way, a desired equivalence ratio distribution may be obtained by adjusting the number and positions of the fuel injection holes.

At this time, the fuel-air concentration in the pilot flow path 220 and the fuel-air concentration in the main flow path 320 are adjusted differently to enable two-stage stratified combustion according to different combustion conditions, thereby significantly improving the flame stability. For example, by adjusting the concentration of fuel in the pilot path 220 to be higher than the concentration of fuel in the main path 320, the flame stability in the center of the nozzle assembly 1000 may be significantly improved. However, the exemplary embodiment is not limited thereto, and the fuel-air concentration in the pilot flow path 220 and the fuel-air concentration in the main flow path 320 may also be equally adjusted according to the driving purposes. Alternatively, the concentration of fuel in the pilot flow path 220 may be adjusted to be lower than the concentration of fuel in the main flow path 320 according to the driving purposes.

Figure 7:
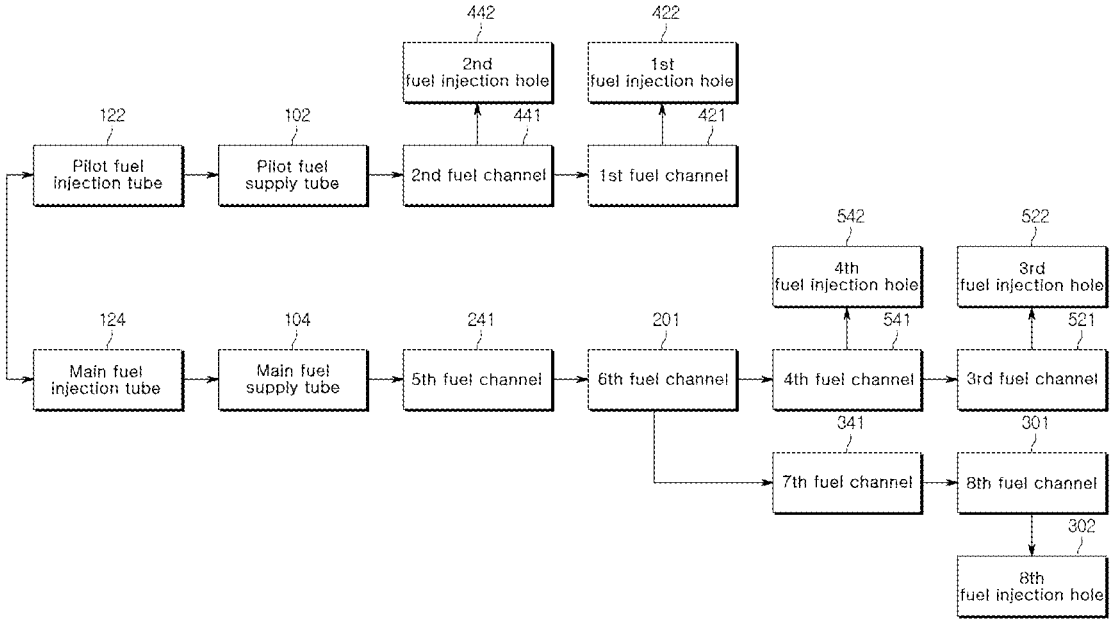
FIG. 7 is a conceptual diagram illustrating a fuel supply structure of the nozzle assembly of FIG. 4.
Figure 8:
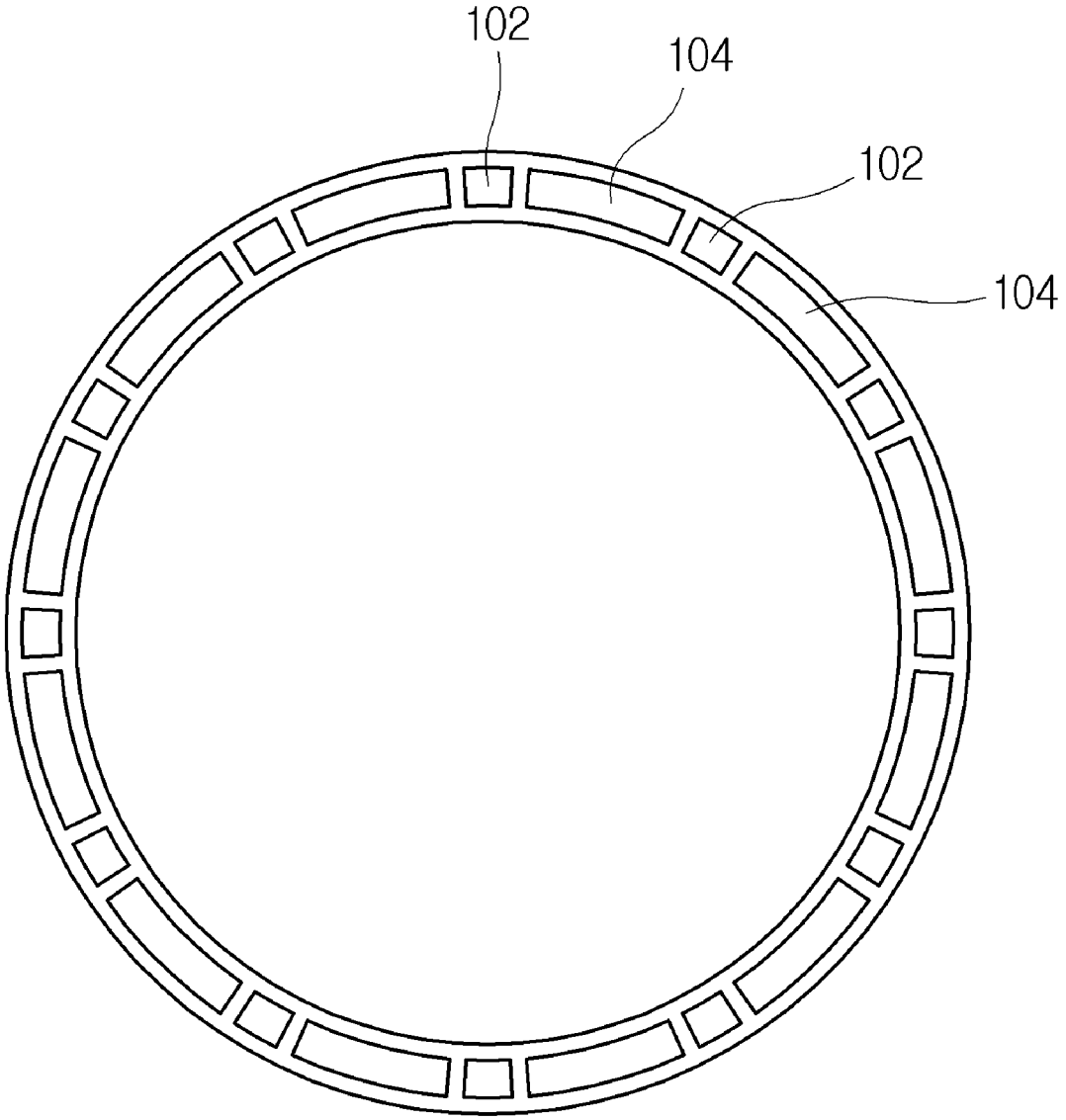
FIG. 8 is a cross-sectional view illustrating a central nozzle tube.

Hereinafter, a structure for supplying fuel to the pilot annular ring 420 and the plurality of pilot struts 440 will be described with reference to FIGS. 7 and 8. Referring to FIGS. 7 and 8, the pilot annular ring 420 and the pilot struts 440 have a hollow shape. Accordingly, a first fuel channel 421 having a hollow annular ring shape is provided in the pilot annular ring 420, and a second fuel channel 441 having a hollow rod shape is provided in each of the pilot struts 440. In this case, each of the second fuel channels 441 communicates with the first fuel channel 421 so that fuel in the second fuel channel 441 may be delivered to the first fuel channel 421.

In order to supply fuel to the second fuel channel 441 of the pilot strut 440 from the outside of the nozzle assembly 1000, the central nozzle tube 100 is provided therein with a pilot fuel supply tube 102 extending along the longitudinal direction thereof. The pilot fuel supply tube 102 extends along the longitudinal direction of the central nozzle tube 100 to communicate with the second fuel channel 441 of the pilot strut 440. Here, one pilot fuel supply tube 102 may be provided for each pilot strut 440 to supply fuel to each of the second fuel channels 441 formed in the pilot struts 440. That is, as illustrated in FIG. 8, the pilot fuel supply tubes 102 formed to be spaced apart from each other may be provided inside the central nozzle pipe 100.

Accordingly, fuel introduced into the pilot fuel supply tubes 102 from the outside of the nozzle assembly 1000 may be supplied to each second fuel channel 441 of the pilot strut 440, and may be supplied to the first fuel channel 421 of the pilot annular ring 420 from the second fuel channels 441. At this time, because all of the first fuel injection holes 422 communicate with the first fuel channel 421, the fuel supplied to the first fuel channel 421 may be injected into the pilot flow path 220 through the first injection holes 422. In addition, even when the pilot strut 440 is provided with a plurality of second fuel injection holes 442, all of the second fuel injection holes 442 communicate with the second fuel channels 441, so that fuel supplied to the second fuel channels 441 may be injected into the pilot flow path 220 through the second fuel injection holes 442.

As described above, while the fuel may be directly introduced into the pilot fuel supply tubes 102 from the outside of the nozzle assembly 1000, the fuel may be introduced through a flange 120 mounted on a front end side of the central nozzle tube 100 according to exemplary embodiments. To this end, a plurality of pilot fuel injection tubes 122 may be provided in the flange 120 to connect with the pilot fuel supply tubes 102 at an end surface of the flange 120. That is, fuel may be introduced into each pilot fuel supply tube 102 through the pilot fuel injection tubes 122 from the end surface of the flange 120.

Hereinafter, a structure for supplying fuel to the main annular ring 520 and the main struts 540 will be described. The main annular ring 520 and the main struts 540 have a hollow shape. Accordingly, a third fuel channel 521 having a hollow annular ring shape is provided in the main annular ring 520, and fourth fuel channels 541 having a hollow rod shape are respectively provided in the main struts 540. At this time, each of the fourth fuel channels 541 communicates with the third fuel channel 521 so that fuel in the fourth fuel channels 541 may be delivered into the third fuel channel 521.

In order to supply fuel to the fourth fuel channels 541 of the main struts 540 from the outside of the nozzle assembly 1000, a main fuel supply tube 104 is provided in the central nozzle tube 100 to extend along the longitudinal direction of the central nozzle tube 100. In addition, a plurality of first fuel supply struts 240 are provided in the pilot flow path 220 to extend radially from the central nozzle tube 100 to the inner nozzle tube 200. The first fuel supply struts 240 are preferably arranged at regular intervals along the circumferential direction. Although not limited thereto, the first fuel supply struts 240 may be disposed on rear sides of each pilot strut 440 in a correspondence manner. Each of the first fuel supply struts 240 has a hollow shape so that a fifth fuel channel 241 having a hollow rod shape is provided in each of the first fuel supply struts 240. Accordingly, the main fuel supply tube 104 extends along the longitudinal direction of the central nozzle tube 100 to communicate with the fifth fuel channel 241 of the first fuel supply strut 240. At this time, one main fuel supply tube 104 may be provided for each of the first fuel supply struts 240 to supply fuel to each of the fifth fuel channels 241 formed in the first fuel supply struts 240. That is, as illustrated in FIG. 8, a plurality of main fuel supply tubes 104 may be formed in the central nozzle tube 100 to be spaced apart from each other. Although not limited thereto, the pilot fuel supply tubes 102 and the main fuel supply tubes 104 may be alternately arranged in the circumferential direction within the central nozzle tube 100.

The inner nozzle tube 200 also has a hollow shape so that a sixth fuel channel 201 having a hollow annular ring shape is provided in the inner nozzle tube 200. The sixth fuel channel 201 of the inner nozzle tube 200 communicates simultaneously with the fifth fuel channels 241 located on the radially inner surface thereof and the fourth fuel channels 541 located on the radially outer surface.

Accordingly, fuel introduced into the main fuel supply tubes 104 from the outside of the nozzle assembly 1000 is supplied to the fifth fuel channels 241 of the first fuel supply strut 240, and may be supplied to the sixth fuel channel 201 of the inner nozzle tube 200 from the fifth fuel channels 241. Subsequently, the fuel is supplied from the sixth fuel channel 201 to the fourth fuel channels 541 of the main strut 540 and is supplied to the third fuel channel 521 of the main annular ring 520 from the fourth fuel channels 541. At this time, because all of the third fuel injection holes 522 communicate with the third fuel channel 521, the fuel supplied to the third fuel channel 521 may be injected into the main flow path 320 through the third injection holes 522. In addition, because all of the fourth fuel injection holes 542 communicate with the fourth fuel channel 541, the fuel supplied to the fourth fuel channel 541 may be injected into the main flow path 320 through the fourth injection holes 542.

As described above, although fuel may be directly introduced into the main fuel supply tubes 104 from the outside of the nozzle assembly 1000, the fuel may be introduced through the flange 120 mounted on the front side of the central nozzle tube 100 according to exemplary embodiments. To this end, a plurality of main fuel injection tubes 124 connected to the main fuel supply tubes 104 from an end surface of the flange 120 may be provided inside the flange 120. That is, fuel may be introduced into the main fuel supply tubes 104 through the main fuel injection tubes 124 from the end surface of the flange 120.

In the main flow path 320, a main swirler 700 may be provided downstream of the main fuel injector 500. The main swirler 700 may generate a swirling flow to further improve mixing characteristics of a fuel-air mixture. The main swirler 700 may have an airfoil-shaped cross-sectional structure that increases aerodynamic characteristics. Alternatively, the main swirler may have a simplified planar structure. Meanwhile, a swirler may be further provided downstream of the pilot fuel injector 400 in the pilot flow path 220.

Because the main flow path 320 is located radially outward than the pilot flow path 220 and has a diameter greater than that of the pilot flow path 220, a distance between adjacent main struts 540 is relatively greater than a distance between adjacent pilot struts 440. Accordingly, there may be a region (i.e., zero-fuel region) in which fuel injected from the main annular ring 520 and the main strut 540 does not reach radially outward of the main flow path 320, i.e., near the outer nozzle tube 300.

As described above, in order to prevent non-uniform mixing of fuel and air due to the zero-fuel region near the outer nozzle tube 300, the exemplary embodiment may further include a plurality of eighth fuel injection holes 302 provided in the outer nozzle tube 300.

The eighth fuel injection holes 302 are provided on a radially inner surface of the outer nozzle tube 300 so that fuel can be injected toward the radially inner side of the outer nozzle tube 300. In addition, the eighth fuel injection holes 302 are preferably provided uniformly along the circumferential direction of the outer nozzle tube 300. For example, three eighth fuel injection holes 302 may be disposed at regular intervals between adjacent main struts 540. For example, the eighth fuel injection holes 302 are preferably provided at positions in which fuel is most likely not reachable through the third fuel injection hole 522 and the fourth fuel injection hole 542, i.e., at centers of adjacent main struts 540. Accordingly, even in the vicinity of the outer nozzle tube 300, the fuel-air mixing is uniformly performed along the circumferential direction to obtain excellent fuel-air mixing characteristics.

Here, a structure for supplying fuel to the outer nozzle tube 300 will be described with reference to FIG. 7. The outer nozzle tube 300 has a hollow shape so that an eighth fuel channel 301 having a hollow annular ring shape is provided in the outer nozzle tube 300. Because all of the eighth fuel injection holes 302 communicate with the eighth fuel channel 301, the fuel supplied to the eighth fuel channel 301 may be injected into the main flow path 320 through the eight fuel injection holes 302.

In addition, a plurality of second fuel supply struts 340 extending radially from the inner nozzle tube 200 to the outer nozzle tube 300 may be provided inside the main flow path 320. It is preferable that the second fuel supply struts 340 are disposed at regular intervals along the circumferential direction. Although not limited thereto, the second fuel supply struts 340 may be disposed on rear sides of each main strut 540 in a correspondence manner. Each of the second fuel supply struts 340 has a hollow shape so that a seventh fuel channel 341 having a hollow rod shape is provided in each of the second fuel supply struts 340. The seventh fuel channels 341 communicate with the sixth fuel channel 201 of the inner nozzle tube 200 on the radially inner side and the eighth fuel channel 301 of the outer nozzle tube 300 on the radially outer side.

Accordingly, fuel may be supplied from the outside of the nozzle assembly 1000 to the seventh fuel channel 341 of the second fuel supply strut 340 through the main fuel supply tubes 104, the fifth fuel channels 241, and the sixth fuel channel 201, and may be supplied to the eighth fuel channel 301 of the outer nozzle tube 300 from the seventh fuel channels 341. The fuel supplied to the eighth fuel channel 301 may be injected into the main flow path 320 through the eighth fuel injection holes 302 communicating with the eighth fuel channel 301.

Figure 9:
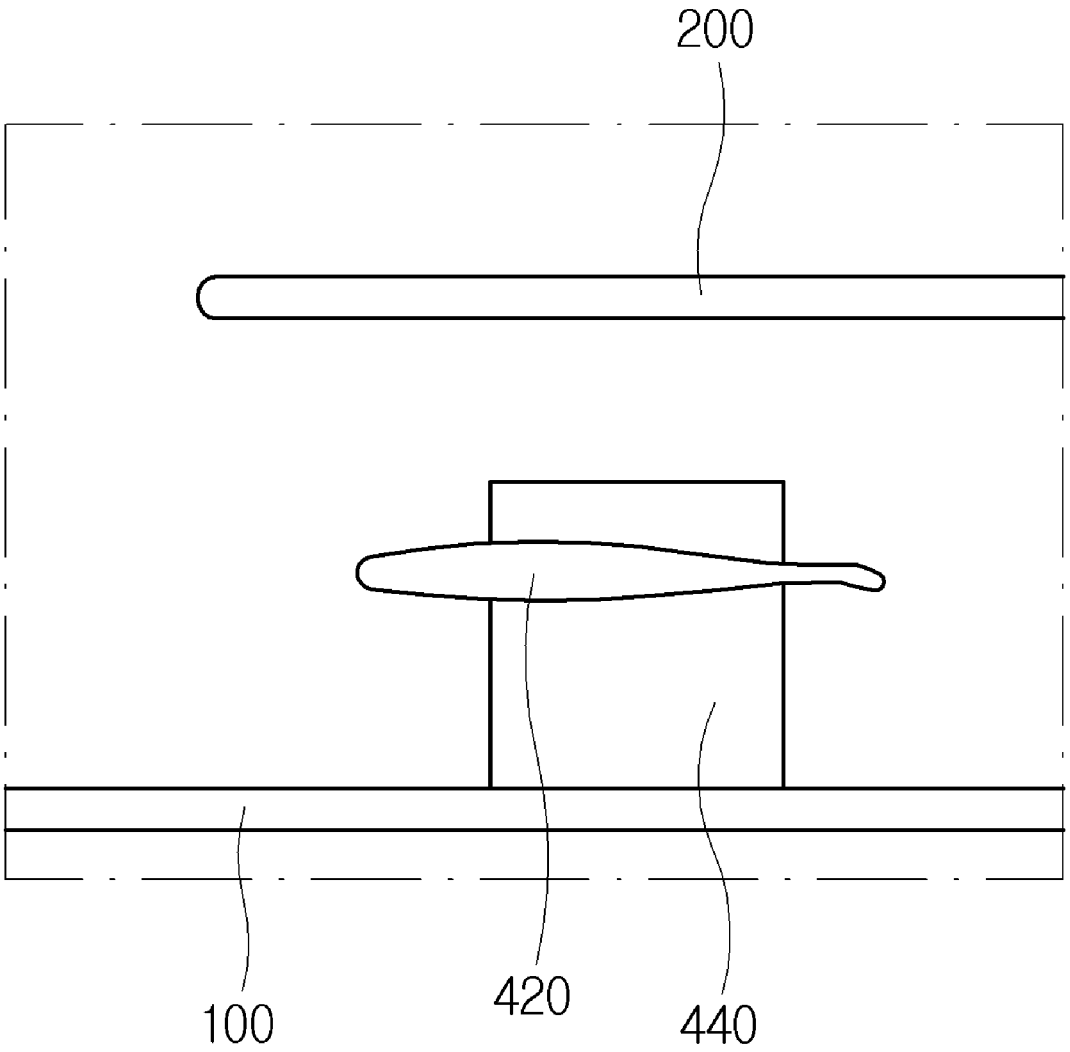
FIG. 9 is a cross-sectional view illustrating a pilot annular ring according to another exemplary embodiment.
Figure 10:
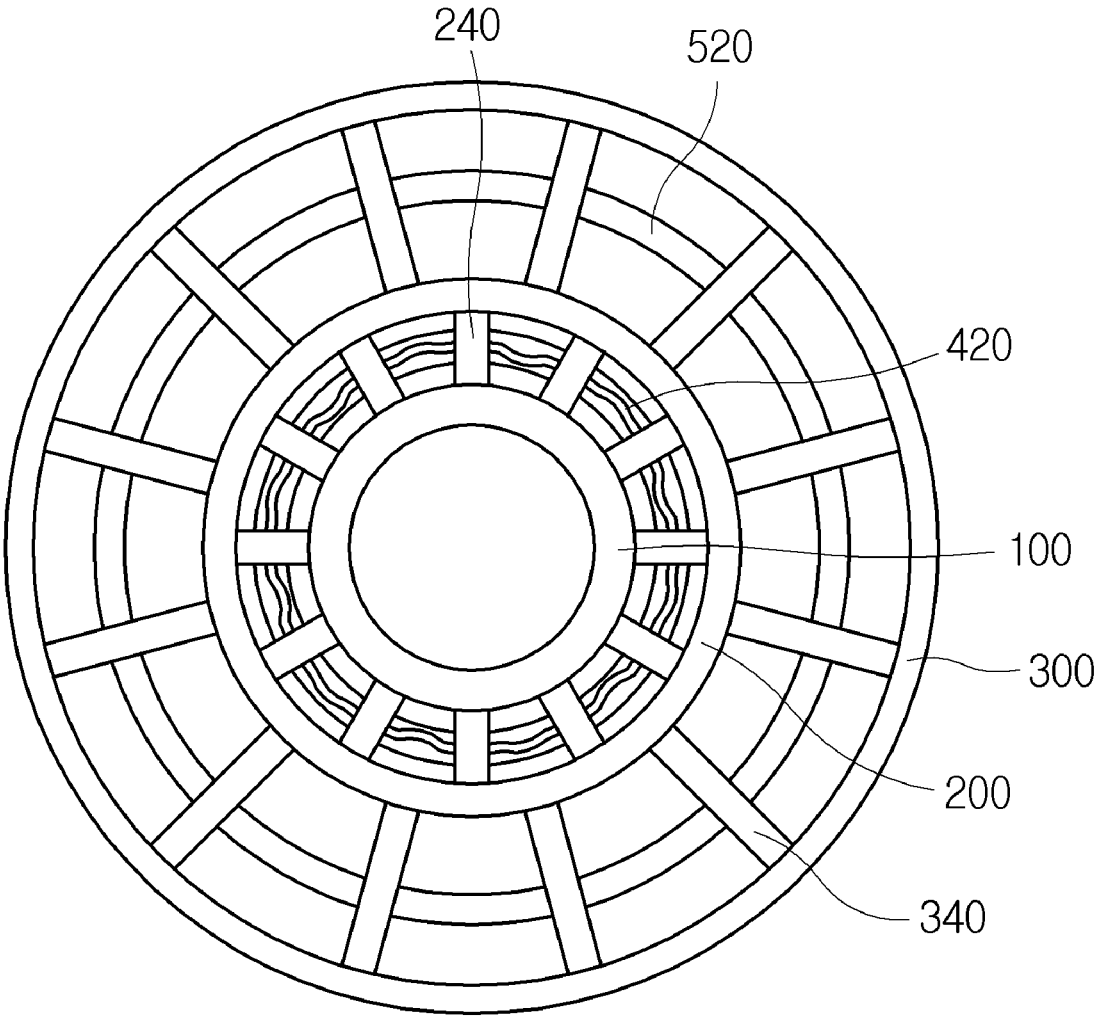
FIG. 10 is a back side view illustrating the annular pilot ring of FIG. 9.

According to an exemplary embodiment, the rear side of the pilot annular ring 420 in an airflow direction may be applied with a corrugated structure having upward and downward folds in a radial direction. FIG. 9 illustrates a cross-section of the pilot annular ring 420 to which the corrugated rear side is applied, and FIG. 10 illustrates a back side view of the pilot annular ring 420 to which the corrugated rear side is applied. As such, the corrugated rear side mixes a flow of fuel-air mixture gas up and down in the radial direction in the pilot flow path 220 to further improve the degree of fuel-air mixing.

Figure 11:
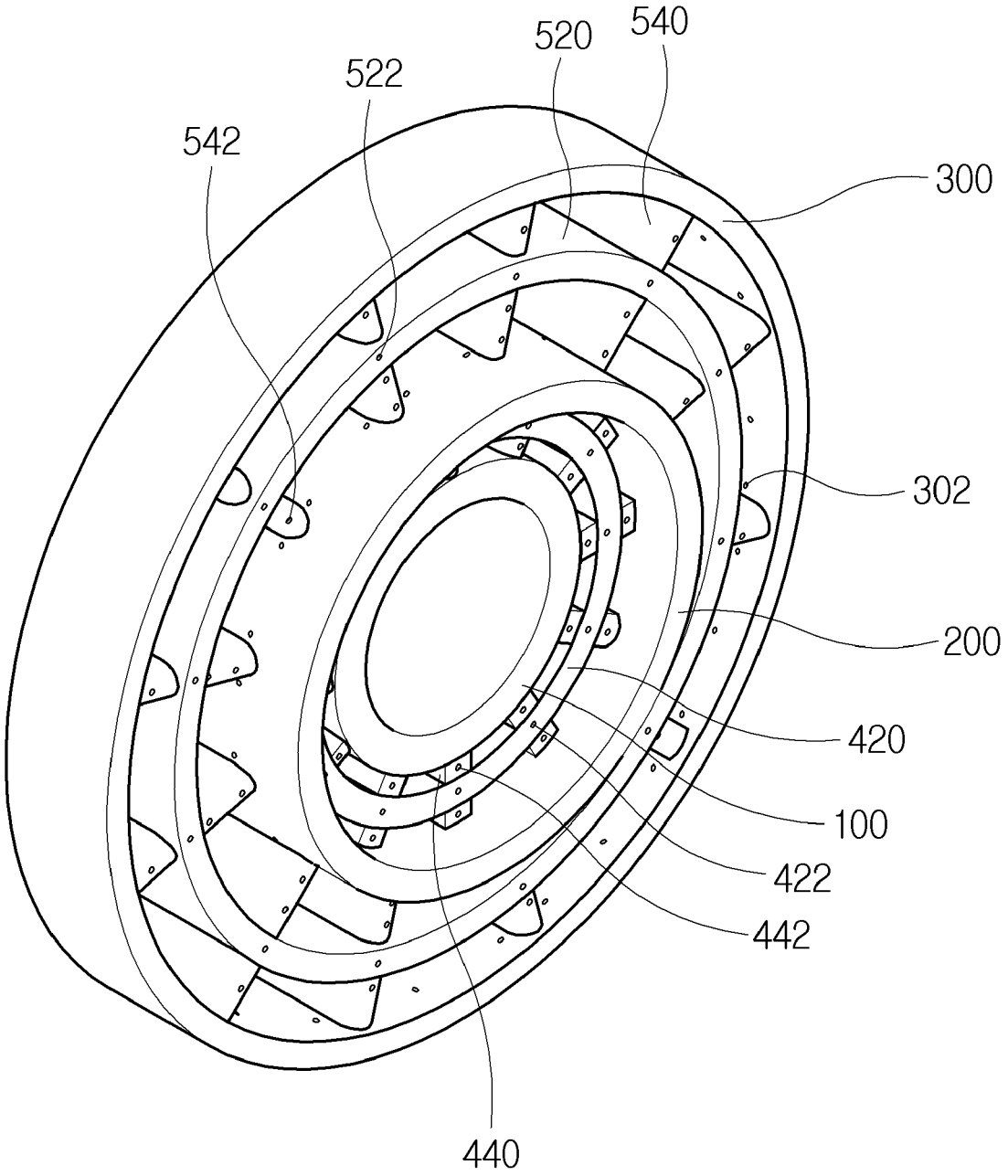
FIG. 11 is a perspective view illustrating a part of a combustor nozzle assembly according to another exemplary embodiment.

FIG. 11 is a perspective view illustrating a part of a combustor nozzle assembly according to another exemplary embodiment. Referring to FIG. 11, the first to fourth fuel injection holes 422, 442, 522, and 542 may be formed toward the rear side of the nozzle assembly 1000. That is, the first fuel injection holes 422 are formed on the rear side of the pilot annular ring 420, the second fuel injection holes 442 are formed on the rear side of the pilot strut 440, the third fuel injection holes 522 are formed on the rear side of the main annular ring 520, and the fourth fuel injection holes 542 are formed on the rear side of the main strut 540. Accordingly, the fuel is injected toward the rear side of the nozzle assembly 1000 through the first to fourth fuel injection holes 422, 442, 522, and 542, thereby preventing occurrence of fuel congestion regions near the annular ring and the rear side of the strut through high-speed fuel injection. In this way, as the fuel injection holes are formed toward the rear side of the nozzle assembly 1000, it is possible to prevent combustion in the nozzle assembly 1000 by the congestion region, and at the same time, it is possible to easily perform processing and inspection of the fuel injection holes. The eighth fuel injection hole 302 of the outer nozzle tube 300 is also provided on the radially inner surface of the outer nozzle tube 300 near the rear side of the nozzle assembly 1000.

Hereinafter, a process of assembling the nozzle assembly 1000 according to exemplary embodiments will be described. The central nozzle tube 100, the inner nozzle tube 200 and the outer nozzle tube 300, and the main swirler 700 may be mounted in a fuel distributor, if necessary, the flange 120 may be mounted on the front side of the central nozzle tube 100 to configure the nozzle assembly 1000, and the resulting structure may be mounted to the combustor 30 after being attached to the end plate 38. According to another exemplary embodiment, as the outer nozzle tube 300 to which the main swirler 700 is attached is mounted on a cover of the combustion chamber 31 and the rest of the configuration is inserted into and assembled with the outer nozzle tube 300, the nozzle assembly 1000 can be easily installed in the combustor 30. That is, as the central nozzle tube 100, the inner nozzle tube 200, the pilot fuel injector 400, and the main fuel injector 500 are inserted in an assembled state into the outer nozzle tube 300 to which the main swirler 700 is attached, the nozzle assembly 1000 is assembled.

While exemplary embodiments have been described with reference to the accompanying drawings, it is to be understood by those skilled in the art that various modifications in form and details may be made therein without departing from the sprit and scope as defined by the appended claims. Therefore, the description of the exemplary embodiments should be construed in a descriptive sense and not to limit the scope of the claims, and many alternatives, modifications, and variations will be apparent to those skilled in the art.

What is claimed is:

1. A combustor nozzle assembly comprising:

a central nozzle tube;

an inner nozzle tube surrounding the central nozzle tube in a spaced-apart state;

an outer nozzle tube surrounding the inner nozzle tube in a spaced-apart state;

a pilot fuel injector provided between the central nozzle tube and the inner nozzle tube; and a main fuel injector provided between the inner nozzle tube and the outer nozzle tube, wherein the pilot fuel injector comprises:

a pilot annular ring disposed between the central nozzle tube and the inner nozzle tube; and a plurality of pilot struts extending radially from the central nozzle tube toward the pilot annular ring, wherein the pilot annular ring includes a plurality of first fuel injection holes along a circumferential direction thereof.

2. The combustor nozzle assembly according to claim 1, wherein a pilot flow path is formed between the central nozzle tube and the inner nozzle tube, and a main flow path is formed between the inner nozzle tube and the outer nozzle tube, wherein fuel-air concentration in the pilot flow path and fuel-air concentration in the main flow path are adjusted to be equal to or different from each other according to an operation purpose.

3. The combustor nozzle assembly according to claim 2, wherein a fuel concentration in the pilot flow path is adjusted to be higher or lower than a fuel concentration in the main flow path according to the operation purpose.

4. The combustor nozzle assembly according to claim 1, wherein the plurality of pilot struts are arranged at regular intervals along a circumferential direction of the central nozzle tube.

5. The combustor nozzle assembly according to claim 1, wherein the plurality of first fuel injection holes are formed in each of radially inner and outer surfaces of the annular pilot ring.

6. The combustor nozzle assembly according to claim 1, wherein a second fuel injection hole is formed in each of the plurality of pilot struts.

7. The combustor nozzle assembly according to claim 6, wherein each of the plurality of pilot struts is provided with a plurality of second fuel injection holes on side surfaces facing each other in a circumferential direction of the pilot strut.

8. The combustor nozzle assembly according to claim 1, wherein each of the plurality of pilot struts includes:

a first pilot strut part extending from the central nozzle tube to the pilot annular ring; and a second pilot strut part extending radially from the pilot annular ring toward the inner nozzle tube.

9. The combustor nozzle assembly according to claim 1, wherein the main fuel injector comprises:

at least one main annular ring disposed between the inner nozzle tube and the outer nozzle tube; and a plurality of main struts extending radially from the inner nozzle tube toward the main annular ring.

10. The combustor nozzle assembly according to claim 9, wherein the plurality of main struts are arranged at regular intervals along a circumferential direction of the inner nozzle tube.

11. The combustor nozzle assembly according to claim 9, wherein the main annular ring includes a plurality of third fuel injection holes along a circumferential direction thereof.

12. The combustor nozzle assembly according to claim 11, wherein the plurality of third fuel injection holes are formed in each of radially inner and outer surfaces of the main annular ring.

13. The combustor nozzle assembly according to claim 9, wherein a fourth fuel injection hole is formed in each of the plurality of main struts.

14. The combustor nozzle assembly according to claim 13, wherein each of the plurality of main struts is provided with a plurality of fourth fuel injection holes on side surfaces facing each other in a circumferential direction of the main strut.

15. The combustor nozzle assembly according to claim 9, wherein each of the plurality of main struts includes:

a first main strut part extending from the inner nozzle tube to the main annular ring; and a second main strut part extending radially from the main annular ring toward the outer nozzle tube.

16. The combustor nozzle assembly according to claim 1, further comprising:

a main swirler provided on a downstream side of the main fuel injector in an airflow direction to generate a swirling flow, wherein the central nozzle tube, the inner nozzle tube, the pilot fuel injector, and the main fuel injector are inserted in an assembled state into the outer nozzle tube to which the main swirler is attached.

17. The combustor nozzle assembly according to claim 1, wherein the pilot annular ring has a rear side corrugated in a radial direction thereof.

18. A gas turbine combustor comprising:

a liner configured to define a combustion chamber;

a flow sleeve configured to surround the liner to form an annular flow space therebetween;

an end plate coupled to a front side of the flow sleeve; and a nozzle assembly supported by the end plate and coupled to a front side of the liner, the nozzle assembly comprising:

a central nozzle tube;

an inner nozzle tube surrounding the central nozzle tube in a spaced-apart state;

an outer nozzle tube surrounding the inner nozzle tube in a spaced-apart state;

a pilot fuel injector provided between the central nozzle tube and the inner nozzle tube; and a main fuel injector provided between the inner nozzle tube and the outer nozzle tube; and wherein the pilot fuel injector comprises;

a pilot annular ring disposed between the central nozzle tube and the inner nozzle tube; and a plurality of pilot struts extending radially from the central nozzle tube toward the pilot annular ring, wherein the pilot annular ring includes a plurality of first fuel injection holes along a circumferential direction thereof.

19. A combustor nozzle assembly comprising:

a central nozzle tube;

an inner nozzle tube surrounding the central nozzle tube in a spaced-apart state;

an outer nozzle tube surrounding the inner nozzle tube in a spaced-apart state;

a pilot fuel injector provided between the central nozzle tube and the inner nozzle tube; and a main fuel injector provided between the inner nozzle tube and the outer nozzle tube, wherein the main fuel injector comprises:

at least one main annular ring disposed between the inner nozzle tube and the outer nozzle tube; and a plurality of main struts extending radially from the inner nozzle tube towards the main annular ring, wherein a pilot flow path formed between the central nozzle tube and inner nozzle tube, and a main flow path is formed between the inner nozzle tube and the outer nozzle tube, wherein fuel-air concentration in the pilot flow path and fuel-air concentration in the main flow path are adjusted to be equal to or different from each other according to an operation purpose.

* * * * *